United States Patent [19]

Sisson, Jr.

[11] Patent Number: 5,012,114

[45] Date of Patent: Apr. 30, 1991

[54] RADIATION SHIELD

[75] Inventor: Fred U. Sisson, Jr., Westfield, Mass.

[73] Assignee: Charles H. Yanke, River Hills, Wis. ; a part interest

[21] Appl. No.: 372,900

[22] Filed: Jun. 28, 1989

[51] Int. Cl.[5] ..... G21F 3/02

[52] U.S. Cl. ..... 250/519.1; 250/515.1; 250/516.1

[58] Field of Search ..... 250/519.1, 516.1, 515.1, 250/506.1

[56] References Cited

U.S. PATENT DOCUMENTS

| | | | |
|---|---|---|---|
| 2,749,448 | 6/1956 | Appelbaum et al. | 250/516.1 |
| 2,756,172 | 7/1956 | Kidd | 250/519.1 |
| 2,960,561 | 11/1960 | Plummer | 250/519.1 |
| 3,233,248 | 2/1966 | Bushnell | 250/516.1 |
| 3,569,713 | 3/1971 | Via, Jr. | 250/516.1 |
| 4,220,867 | 9/1980 | Bloch, Jr. | 250/516.1 |
| 4,266,139 | 5/1981 | Sportelli et al. | 250/515.1 |

*Primary Examiner*—Jack I. Berman
*Assistant Examiner*—Kiet T. Nguyen
*Attorney, Agent, or Firm*—Victor E. Libert

[57] ABSTRACT

A radiation shield comprises a wrappable sheet of radiation-shielding material such as lead-filled plastic sheet faced on one side with a vinyl facing sheet and on the other side with a sheet of heat-resistant material. Releasable contact-fasteners, preferably of the type sold under the trademark Velcro, are affixed to the wrappable sheet, as by being attached to the vinyl facing sheet, to provide first and second complementary locking portions of the fasteners. The radiation shield is dimensioned and configured to be wrapped around a radiation-emitting structure such as a conduit or pipe to encircle at least a segment of the structure; the Velcro®-type fasteners affixed to the sheet are so dimensioned and configured that with the shield wrapped in encircling engagement about the structure, the first and second complementary locking portions are brought into contact and secured to lock the radiation shield in place. The radiation shield may be wrapped around and secured in place on a variety of different sized structures, such as conduits of different diameters.

14 Claims, 3 Drawing Sheets

FIG. 1
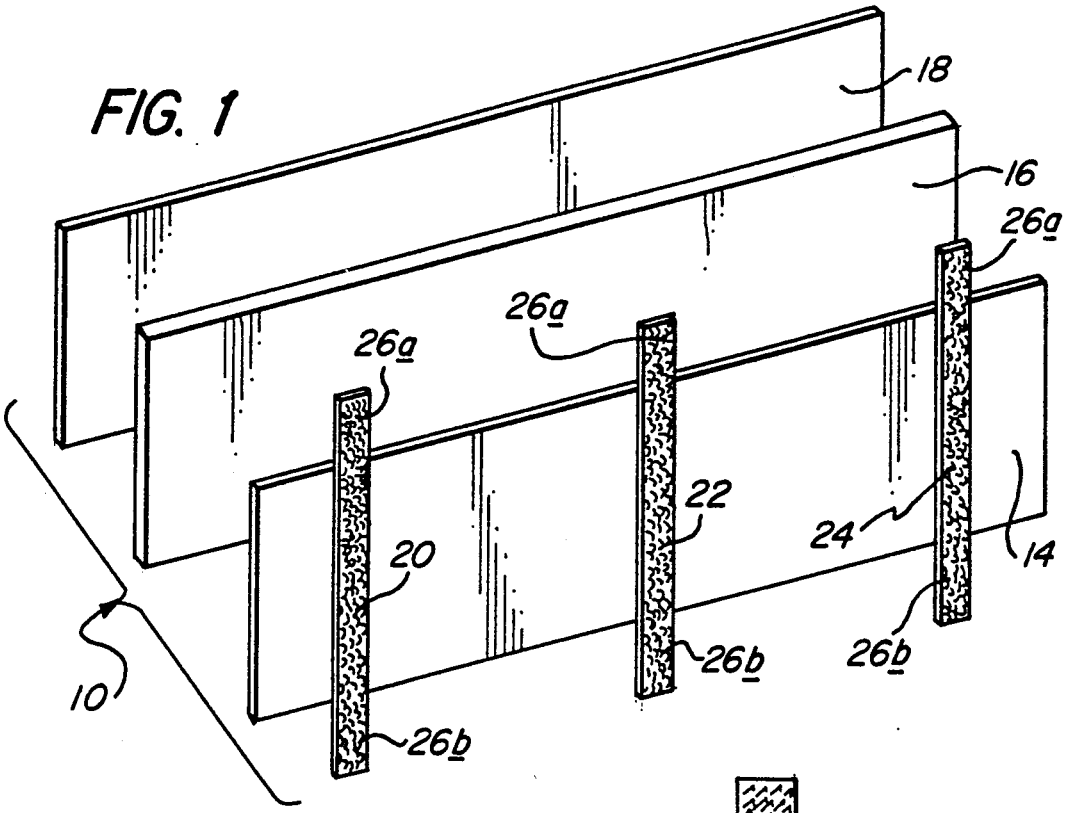
FIG. 1A
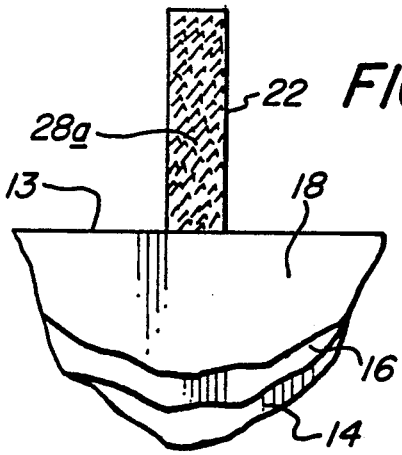
FIG. 2
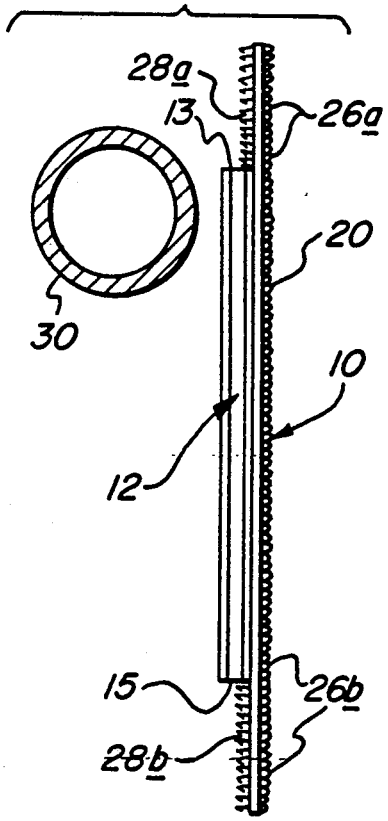
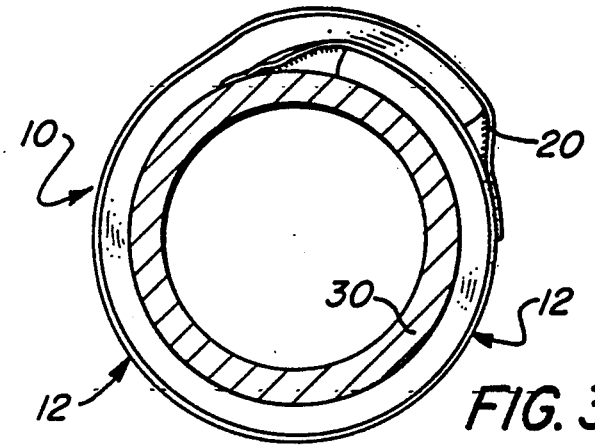
FIG. 3

FIG. 4
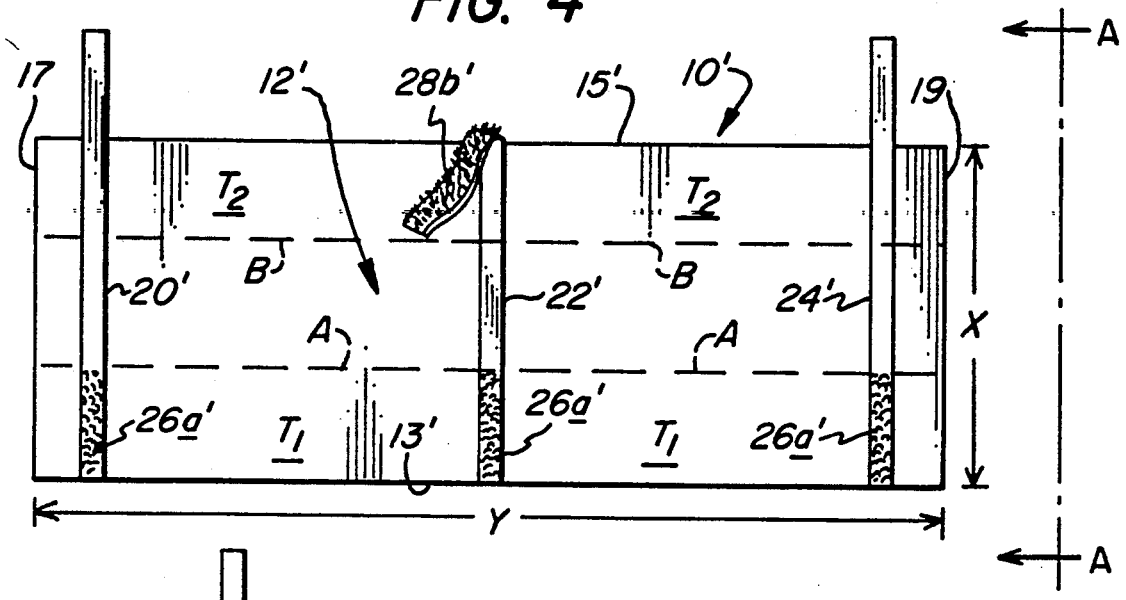
FIG. 5
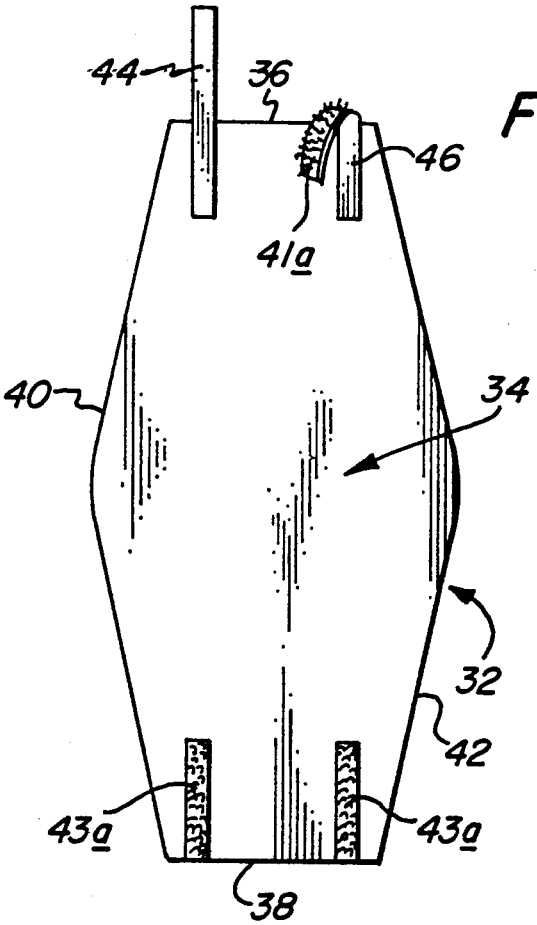
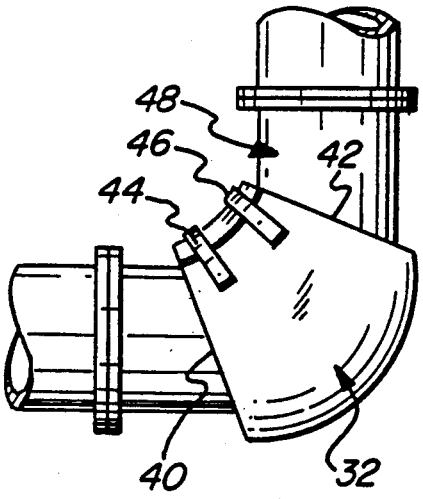
FIG. 6

RADIATION SHIELD

BACKGROUND OF THE INVENTION

The present invention concerns radiation shields of a type used for shielding personnel from radiation emitted from radiation-emitting structures such as nuclear reactors and components thereof, e.g., conduits through which radioactive materials are flowed.

RELATED ART

The use of flexible protective shields to protect personnel against radiation, such as the radiation emanating from x-ray machines, is known in the art as illustrated by U.S. Pat. No. 3,039,001 entitled "Flexible Protective Plastic Shield". This patent discloses that a sheet of vinyl or other plastic material containing resin, plasticizer and stabilizer may have a protective material such as pulverized lead uniformly distributed therethrough, in order to provide a flexible sheet of material which protects the wearer against x-rays, gamma rays, neutron rays, secondary cosmic rays and the like. A flexible sheet of radiation-shielding material is illustrated in FIG. 4 of the Patent as comprising a film 34 containing pulzerized lead uniformly distributed therein and clad by a pair of pigment layers 32, 33 which, as described at the top of column 3 of the patent, may or may not include the pulverized lead, as desired.

U.S. Pat. No. 4,196,355 entitled "Radiation Shield Vest and Skirt" and U.S. Pat. No. 4,441,025 entitled "Protective Devices" each show flexible shielding material adapted to be worn on the human body. The flexible protective sheet material comprises, as described, for example, at column 2, line 15 et seq. of U.S. Pat. No. 4,441,025, known protective materials such as lead-filled vinyl laminated fabrics and the like. Fastener straps of the type sold under the Velcro® trademark are shown affixed to portions of the garments, the Velcro® fasteners being shown, for example, as surfaces 15, 17 and 18, 20 in FIG. 1 of U.S. Pat. No. 4,441,025 and as tabs 34 and 36 in FIG. 1 of U.S. Pat. No. 4,196,355.

U.S. Pat. Nos. 4,432,932 entitled "Reactor Head Shielding System" and 4,530,813, entitled "Modular Reactor Head Shielding System", each show radiation-shielding pads for application to a nuclear reactor head. Fastening strips comprising Velcro® fastener straps are shown as item 42 in each patent and are utilized to secure adjacent overlapping radiation-shielding pads to each other.

SUMMARY OF THE INVENTION

Generally, the present invention provides a radiation shield which comprises a wrappable sheet of radiation-shielding material to which is affixed releasable contact-fasteners which are so dimensioned and configured that when the shield member is wrapped around a radiation-emitting structure, complementary locking portions of the releasable fasteners engage each other to securely hold the shield member in a shielding position wrapped around the structure.

Specifically, in accordance with the present invention, there is provided a radiation shield comprising the following components. A wrappable sheet of radiation-shielding material may be of any suitable configuration, for example, it may be of rectangular configuration, and has a first edge and a second edge which is spaced from and opposite to the first edge. That portion of the wrappable sheet which is adjacent to the first edge defines a first terminal portion of the wrappable sheet, and that portion of the wrappable sheet which is adjacent to the second edge defines a second terminal portion of the wrappable sheet. One or more releasable contact-fasteners are affixed to the wrappable sheet and have first and second locking portions thereof dimensioned and configured to engage each other in locking contact as described below. The radiation shield is dimensioned and configured to be wrapped around a radiationemitting structure in a shielding position in which the first terminal portion and the second terminal portion are brought into contact with each other, whereby the radiation shield encircles at least a segment of the structure and the first and second locking portions engage each other in locking contact. In this way, the radiation shield is secured in its shielding position to the structure.

In accordance with another aspect of the present invention, there is provided a radiation shield as described above and wherein the wrappable sheet comprises a core sheet containing lead powder, at least one side of the core sheet being faced with a facing sheet of a thermoplastic synthetic organic polymeric material, such as a vinyl plastic sheet. Further, the first locking portions of the releasable contact-fasteners are located in the first terminal portion of the wrappable sheet, and the second locking portions of the releasable contact-fasteners are located in the second terminal portion of the wrappable sheet.

Other aspects of the present invention provide for the contact-fasteners to be disposed adjacent to the first and second edges and for at least some of them to have projecting portions which project beyond at least one of the first and second edges. Other aspects of the present invention provide for the first and second locking portions of the fasteners to face in opposite directions perpendicularly away from the plane of the wrappable sheet. Generally, at least one of the releasable contact-fasteners is positioned at the first terminal portion and at least one of the releasable contact-fasteners is positioned at the second terminal portion.

In one aspect of the present invention, both the first side and the opposite, second side of the wrappable sheet are faced with a facing sheet of a thermoplastic material. In another aspect of the present invention, one side of the wrappable sheet comprises an inner side and the inner side is faced with a facing sheet of heat-resistant material. In this aspect of the invention, the side of the radiation shield opposite the inner side comprises an outer side of the radiation shield, and the outer side may be faced with a facing sheet of a thermoplastic material.

The radiation shield may have opposite lateral sides which define a convex profile when the shield is lain flat. The wrappable material may comprise a core material containing lead powder therein. Other aspects of the invention are set forth in the following detailed description and in the drawings.

Reference herein and in the claims to a "wrappable" sheet means that the sheet is sufficiently flexible and non-resilient so as to be capable of being wrapped around a structure and held in that position as illustrated, for example, in FIG. 3.

BRIEF DESCRIPTION OF THE DRAWINGS

FIG. 1 is an exploded view of a radiation shield comprising one embodiment of the present invention;

FIG. 1A is a partial plan view, with parts broken away, taken in the area of item 22 of the embodiment of FIG. 1;

FIG. 2 is an end view in elevation of the assembled radiation shield of FIG. 1 positioned adjacent to a conduit, shown in cross section, to which the radiation shield is to be applied;

FIG. 3 is a view on a scale enlarged with respect to FIG. 2, showing the radiation shield of FIG. 2 wrapped around the conduit of FIG. 2;

FIG. 4 is a view similar to that of FIG. 2 showing a radiation shield comprising another embodiment of the present invention;

FIG. 5 is a plan view of a radiation shield comprising yet another embodiment of the present invention; and FIG. 6 is an elevation view of the radiation shield of FIG. 5 shown secured in its shielding position on a ninety degree elbow of a conduit.

DETAILED DESCRIPTION OF THE INVENTION AND PREFERRED EMBODIMENTS THEREOF

Figure 3A:
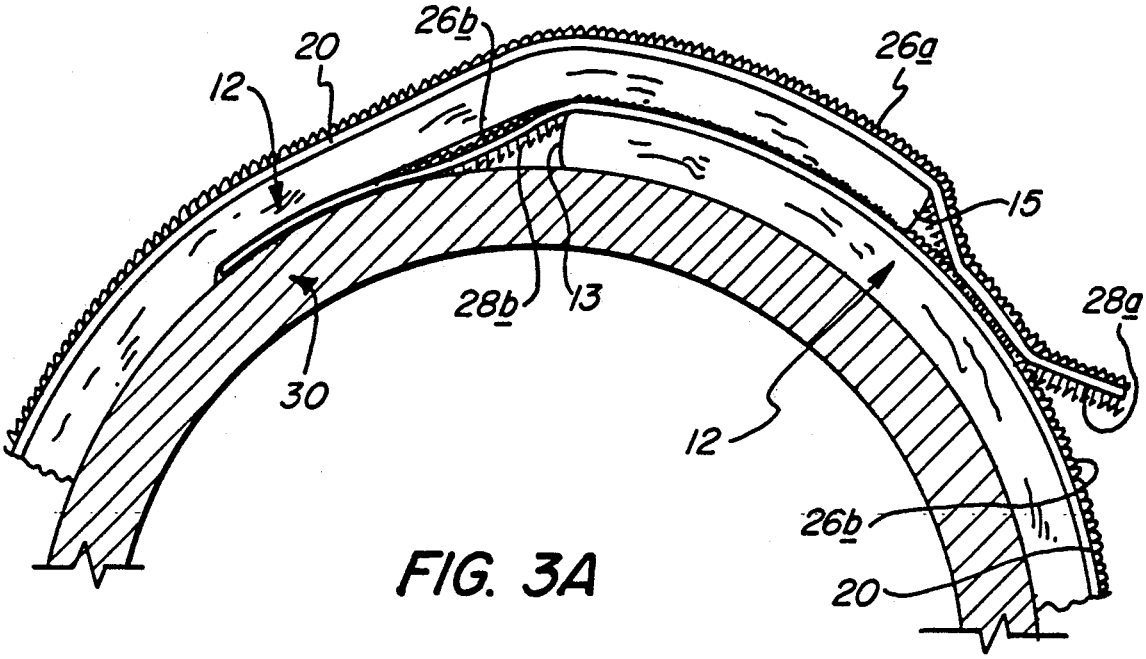
FIG. 3A is a view on an enlarged scale relative to FIG. 3 of the overlapped portion of the radiation shield of FIG. 3 but showing a fastener not fully in the engaged position.

Referring now to FIG. 1, there is shown in exploded view a radiation shield 10 in accordance with an embodiment of the present invention. (Generally, all the Figures of the drawings are somewhat schematic in nature and not necessarily to scale.) Radiation shield 10 is comprised of a wrappable sheet 12 (FIG. 2) comprised, as best seen in FIG. 1, of a core sheet 16 sandwiched between a first facing sheet 14 and a second facing sheet 18. Each of the sheets 14, 16 and 18 are of substantially identical configuration and size (although not necessarily identical in thickness) so that when assembled as shown in FIG. 2, the resultant wrappable sheet 12 comprises a unitary composite structure of the three sheets which structure is of substantially rectangular configuration, having opposed first and second edges 13, 15 (FIG. 2) and lateral side edges (un-numbered). Sheets 14, 16 and 18 may be joined together by any suitable means as by a suitable adhesive, by mechanical fasteners, and the edges of the composite wrappable sheet 12 may be sealed by ultrasonic welding or by the application of a sealing closure strip affixed about the periphery thereof by adhesive, ultrasonic welding or any other suitable means. In an alternate form of construction, facing sheets 14 and 18 may be made slightly larger than core sheet 16 and joined together to form a sleeve or bag-like structure into which core sheet 16 is inserted, the open edge of the bag or sleeve thereupon being sealed to provide wrappable sheet 12 as a composite, layered structure.

Core sheet 16 comprises a radiation-shielding material and may therefore be comprised of the known construction of fine lead powder being uniformly dispersed in a matrix of a thermoplastic material which serves as a binder for the lead powder, forming it into a coherent flexible sheet as is well known to those skilled in the art. Other suitable materials may be employed, provided the resultant wrappable sheet 12 is capable of serving as a radiation shield by attenuating the passage of one or more selected types of radiation, such as alpha rays, beta rays, gamma rays, x-rays, sound waves, etc., therethrough.

First facing sheet 14 may be made of a suitable organic synthetic polymeric material, especially a thermoplastic material such as a suitable vinyl plastic material. Second facing sheet 18 may also be made of a suitable synthetic organic polymeric material, or it may be made of a more heat-resistant material such as a fiberglass fabric or the like. In a preferred embodiment of the invention, first facing sheet 14 is made of a thermoplastic material such as a vinyl plastic and second facing sheet 18 is made of a flexible heat-resistant material such as a fiberglass or fiberglass-reinforced fabric. In that embodiment of construction, the side of the resultant wrappable sheet 12 which is faced with the heat-resistant second facing sheet 18 serves as the inner side of the radiation shield 10; the inner side is the side which is placed into contact with the conduit or other radiation emitting structure. Such structures must sometimes be shielded while the structures are at an elevated temperature and hence the heat-resistant second facing sheet 18 is the surface of the radiation shield 10 which is placed into direct contact with the hot, radiation-emitting structure.

A plurality of straps 20, 22 and 24 are, as shown in FIG. 1, affixed to wrappable sheet 12 by being fastened, in the illustrated embodiment, to first facing sheet 14. Of course, any desired number of straps may be employed in a given case. Straps 20, 22 and 24 may be made of any suitable material and may be secured to first facing sheet 14 in any suitable manner, by adhesives, mechanical fasteners or the like. In one form of construction, straps 20, 22 and 24 are made of a thermoplastic material such as a vinyl sheet material similar or identical to the vinyl sheet material from which first facing sheet 14 may be made, and the straps 20, 22 and 24 are adhered to first facing sheet 14 by ultrasonic welding or similar techniques, or by adhesives.

In any case, releasable contact-fasteners are affixed to the straps 20, 22 and 24. These releasable contact-fasteners are preferably hook-and-loop type or other suitable type fabric fasteners such as, or similar to those, sold under the trademark Velcro ®. As illustated in FIGS. 1 and 2, such Velcro ®-type fasteners are used to provide the first locking portions 26*a*, 26*b* of releasable contact-fasteners secured to respectively, straps 20, 22 and 24. The fasteners of first locking portions 26*a*, 26*b* extend along the entire length of straps 20, 22 and 24 in the illustrated embodiment of FIG. 1.

As seen in FIGS. 1, 1A and 2, the terminal ends of straps 20, 22 and 24 project beyond, respectively, first edge 13 and second edge 15 of wrappable sheet 12 to provide projecting portions (un-numbered) of the straps 20, 22 and 24. The sides of the straps 20, 22 and 24 opposite the sides on which first locking portions 26*a*, 26*b* are affixed have second locking portions 28*a*, 28*b* affixed thereto, on the projecting portions of the straps. First locking portions 26*a*, 26*b* cooperate with second locking portions 28*a*, 28*b* to provide the releasable contact-fasteners. More specifically, depending upon which side of wrappable sheet is used as the inside of radiation shield 10, first locking portion 26*a* will cooperate with the second locking portion 28*b* or first locking portion 26b will cooperate with second locking portion 28a to provide the releasable contactfastener, as is best seen in FIG. 3A. Accordingly, when one of the paired locking portions 26a or 26b is brought into pressure contact with the corresponding locking portions 28b or 28a, the contact-fasteners will grippingly engage one another and lock together. As is well known, although Velcro ®-type fasteners will lock with a strong gripping force, they may be readily separated by peeling back one of the fasteners by applying the peeling force in a direction substantially parallel to the plane of the interface between them. Thus, locking portions 26a, 26b may comprise hook-type fasteners and locking portions 28a, 28b may comprise loop-type fasteners. It should be understood that any suitable type of releasable fasteners may be employed and fasteners 26a, 26b and 28a, 28b may be identical, i.e., they may all comprise hook-type fasteners which will engage one with the other with a suitable gripping force. Thus, as used herein and in the claims, reference to "hook-and-loop" type fasteners is intended to include other configurations of Velcro ®-type fasteners, such as hook-and-hook type fasteners. It will be appreciated that the Velcro ®type fasteners are available on a fabric or plastic backing which may be adhered to the straps 20, 22 and 24 by any suitable means such as mechanical fasteners and/or adhesive.

There is shown in cross section in FIGS. 2 and 3 a conduit 30, which may comprise a pipe or conduit through which radioactive materials are transported, conduit 30 thereby comprising a radiation-emitting structure which may also be at an elevated temperature. For example, it may be necessary to shield workers from conduit 30 shortly after shutdown of a nuclear reactor whose heated cooling water has been transported through conduit 30. Radiation shield 10 is shown in FIG. 2 positioned adjacent to conduit 30; the portion of wrappable sheet 12 adjacent first edge 13 will be placed against conduit 30 and wrappable sheet 12 wrapped therearound and overlapped as shown in FIG. 3, so that, as best seen in FIG. 3A, the first locking portions 26b of the releasable contact-fasteners on the projecting portions of straps 20, 22 and 24 are engaged by the second locking portions 28a of the releasable contact-fasteners, on each of straps 20, 22 and 24. FIG. 3 thus shows radiation shield 12 encircling a segment of conduit 30 and retained in a shielding position thereon by engagement of the releasable locking means. In practice, a plurality of radiation shields will be employed side by side to cover a length of conduit or other radiation-emitting structure by encircling the structure with a plurality of radiation shields of the type illustrated. The adjacent shields may be in abutting lateral side to lateral side contact, or adjacent shields may overlap each other slightly to reduce or eliminate the possibility of radiation leakage between adjacent radiation shields.

FIG. 3A shows the connection as not quite completed, the distal end of a projecting portion of strap 20 being shown as having not yet been pressed into place, for purposes of better illustration. The overlapped portion of wrappable sheet 12 in FIG. 3A comprises a first terminal portion of the wrappable sheet 12, and the overlapping portion of wrappable sheet 12 comprises a second terminal portion thereof. The terminal portions of the wrappable sheet are described more fully below with reference to FIG. 4.

Figure 4B:
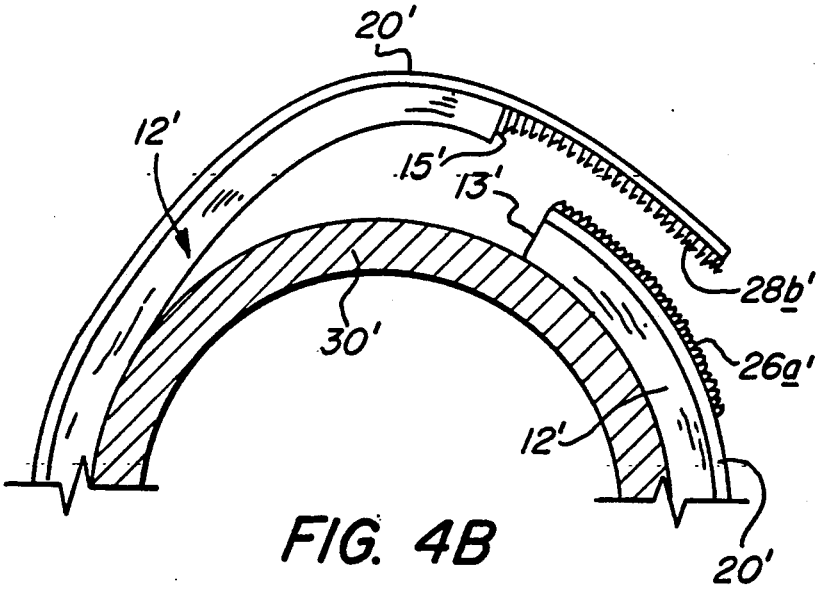
FIG. 4B is a partial view, with parts broken away and on an enlarged scale with respect to FIG. 4, of the terminal portions of the radiation shield of FIG. 4, showing them in a nearly completed stage of being wrapped around a conduit partially shown in cross section.
Figure 4A:
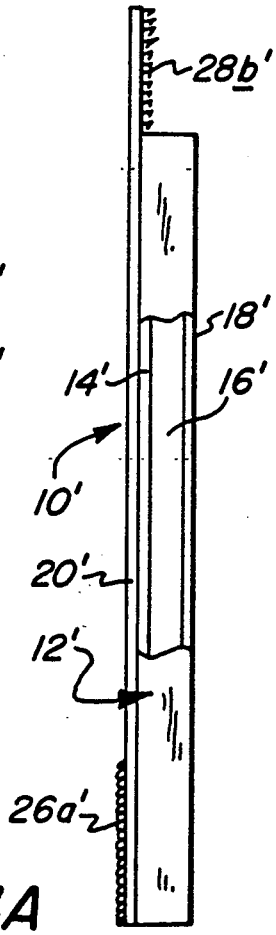
FIG. 4A is a view taken along line A-A of FIG. 4 and on a scale which is enlarged with respect to FIG. 4.

Referring now to FIG. 4, there is shown another embodiment of a radiation shield of the invention in which those parts corresponding, to parts of the embodiment of FIG. 1 are identically numbered, except that prime indicators are added to the numerals. Thus, radiation shield 10' is comprised of a wrappable sheet 12' and a series of straps 20', 22' and 24'. Wrappable sheet 12' may comprise a composite sheet identical or similar to that illustrated with respect to FIG. 1 and has a first edge 13' and a second edge 15' which is spaced from and opposite to first edge 13'. In the illustrated embodiment of FIG. 4 (as well as in that of FIG. 1) first edge 13' and second edge 15' also extend substantially parallel one to the other, as do opposite lateral sides 17 and 19. (The sides of the embodiment of FIG. 1 which correspond to lateral sides 17 and 19 are unnumbered in FIG. 1). In the FIG. 4 embodiment, the releasable contact-fasteners are provided by first locking portions 26a' thereof affixed to an end portion of, respectively, straps 20', 22' and 24'. In this embodiment, the ends of straps 20', 22' and 24' on which the first locking portions 26a' are disposed do not project beyond first edge 13' of wrappable sheet 12'. The opposite ends of straps 20', 22' and 24' each have projecting portions (unnumbered) which project beyond second edge 15' of sheet 12'. On these projecting portions of straps 20', 22' and 24', on the sides thereof opposite to that on which first locking means 26a'are affixed, second locking means 28b' of the releasable contact-fasteners are affixed. Strap 22' is turned back in the illustration of FIG. 4 in order to show the typical second locking portion 28b' affixed thereto; second locking portion 28b' of strap 20' is visible in the end view of FIG. 4A.

In the embodiment of FIG. 4, a dash line A is drawn parallel to and spaced from first edge 13' in order to indicate a segment of the wrappable sheet 12' which lies adjacent to the first edge 13' and defines a first terminal portion $T_1$ of wrappable sheet 12'. Similarly, a dash line B is shown in FIG. 4 to indicate a second terminal portion $T_2$ of wrappable sheet 12' adjacent to second edge 15'. The terminal portions $T_1$ and $T_2$ indicate those segments of wrappable sheet 12' which include the portions which will be brought into contact with each other when radiation shield 10' is emplaced about a conduit or other radiation-emitting structure. Depending on the size of the encircled portion of the structure, terminal portions $T_1$ and $T_2$ may contact each other either in abutting contact at edges 13' and 15' or by being overlapped to a greater or lesser extent, in the manner illustrated in FIGS. 3 and 3A, when the radiation shield 10' is wrapped around a conduit or other structure in order to encircle the same. The dimensions x and y in FIG. 4 illustrate the width and length of the radiation shield 10' and these dimensions may, of course, vary widely depending on the particular configuration of the radiation shield desired. However, in typical cases, the dimension x, may vary, for example, from about six inches to six feet and the dimension y may vary from about three feet to ten feet. Further, although a rectangular configuration is most convenient for wrapping pipes and conduits, other shapes of the radiation shield may be provided for differently shaped structures such as conical or spherical structures, or irregularly shaped structures. One such variation in shape is described below with reference to FIGS. 5 and 6.

Referring now to FIG. 5, there is shown yet another embodiment of the invention comprising a radiation shield 32 comprised of a wrappable sheet 34 having a first edge 36 and a second edge 38 which is opposite to and extends substantially parallel to first edge 36. Radiation shield 32 has a pair of straps 44, 46 which have projecting portions which extend beyond first edge 36 and carry first locking portions 41*a*, only one of which is visible in FIG. 5, on turned-back strap 46. Adjacent to second edge 38 are affixed a pair of the second locking portions 43*a* of the releasable contact-fasteners. It will be noted that the first locking portions 41*a* are provided on the projecting portions of straps 44, 46 on the side thereof which faces away from the plane of wrappable sheet 34 in a direction opposite that in which the second locking portions 43*a* face away from the plane of wrappable sheet 34.

Wrappable sheet 34 has a first lateral side 40 and an opposite, second lateral side 42. Sides 40 and 42 are not of straight line configuration as is the case with the other embodiments illustrated, but show a convex profile in the plan view of FIG. 5. The purpose of this convex profile is to adapt radiation shield 32 to be utilized to wrap the elbow turns of conduits, as illustrated in FIG. 6, which shows radiation shield 32 secured in its shielding position to encircle a segment of a 90° elbow turn 48 of a conduit.

While the invention has been described in detail with respect to specific preferred embodiments thereof, numerous modifications to these specific embodiments will occur to those skilled in the art upon a reading and understanding of the foregoing; such modifications are embraced within the scope of the appended claims.

What is claimed is:

1. A gamma radiation shield comprising;

(a) a wrappable sheet of gamma radiation-shielding material comprising a core sheet containing lead powder, at least one side of the wrappable sheet being faced with a facing sheet of a thermoplastic synthetic organic polymeric material, the wrappable sheet having a first edge and an opposite second edge spaced from the first edge, first segment of the wrappable sheet adjacent the first edge defining a first terminal portion of the wrappable sheet and second segment of the wrappable sheet adjacent the second edge defining a second terminal portion of the wrappable sheet; and (b) one or more releasable contact-fasteners affixed to the wrappable sheet and having first and second locking portions, the first locking portions being located in the first terminal portion, the second locking portions being located in the second terminal portion and at least some of the contact-fasteners extending in a direction transversely of at least one of the first and second edges whereby the degree of overlap of the first and second terminal portions are adjusted to accommodate radiation-emitting structures of different sizes;

the radiation shield being dimensioned and configured to be wrapped around a gamma radiation-emitting structure in a shielding position in which the first terminal portion contacts the second terminal portion, the radiation shield thereby encircling at least a part of the radiation-emitting structure, the first and second locking portions being dimensioned and configured to engage each other in locking contact when the radiation shield is in its shielding position, to thereby secure the radiation shield to the structure.

2. The radiation shield of claim 1 wherein at least some of the contact-fasteners are disposed adjacent to the first and second edges and have projecting portions which project beyond at least one of the first and second edges.

3. The radiation shield of claim 1 or claim 2 wherein the first and second locking portions of the contact-fasteners face in opposite directions perpendicularly away from the plane of the wrappable sheet.

4. The radiation shield of claim 2 wherein at least one side of the wrappable sheet is faced with a facing sheet comprised of a thermoplastic synthetic organic polymeric material.

5. The radiation shield of claim 1 or claim 2 wherein the thermoplastic material comprises a vinyl material facing sheet and wherein the releasable contact-fasteners are affixed to strips of vinyl material affixed to the facing sheet.

6. The radiation shield of claim 1 or claim 2 having a first side and an opposite second side and wherein both the first side and the second side of the wrappable sheet are faced with a facing sheet of a thermoplastic material.

7. The radiation shield of claim 1 or claim 2 wherein one side of the wrappable sheet comprises an inner side of the radiation shield and the inner side is faced with a facing sheet of heat-resistant material.

8. The radiation shield of claim 7 wherein the side of the radiation shield opposite the inner side comprises an outer side of the radiation shield and the outer side is faced with the facing sheet of a thermoplastic material.

9. The radiation shield of claim 1 or claim 2 wherein the releasable contact-fasteners comprise loop-and-hook type fabric fasteners.

10. The radiation shield of claim 1 or claim 2 wherein the wrappable sheet is of substantially rectangular configuration.

11. The radiation shield of claim 1 or claim 2 wherein the first and second edges extend substantially parallel to each other.

12. The radiation shield of claim 1 or claim 2 wherein the radiation shield has opposite lateral sides which have convex profiles when the wrappable sheet is lain flat.

13. The radiation shield of claim 12 wherein the convex profiles are dimensioned and configured to enable the radiation shield to encircle a 90° elbow turn of a circular cross section conduit.

14. The radiation shield of claim 1 or claim 2 wherein the contact-fasteners extend at least from the first edge to the second edge.

* * * * *